United States Patent [19]

Kosaka et al.

[11] 3,932,986

[45] Jan. 20, 1976

[54] METHOD FOR MANUFACTURING A TEXTURED SYNTHETIC MULTIFILAMENT YARN HAVING ALTERNATELY GROUPED S AND Z TWISTS

[75] Inventors: Kenzo Kosaka; Shin Morioka; Kunio Shibata; Takashi Goto, all of Nagoya; Eizi Takahashi, Toyoake, all of Japan

[73] Assignee: Mitsubishi Rayon Co., Ltd., Tokyo, Japan

[22] Filed: Mar. 8, 1974

[21] Appl. No.: 449,492

[52] U.S. Cl. ..... 57/157 TS; 57/157 S

[51] Int. Cl.[2] ..... D02G 1/02; D02G 3/34

[58] Field of Search ..... 57/34 R, 34 HS, 157 R, 57/157 TS, 157 MS, 36, 157 S

[56] References Cited

UNITED STATES PATENTS

| | | | |
|---|---|---|---|
| 3,041,813 | 7/1962 | Enneking | 57/157 TS X |
| 3,041,814 | 7/1962 | Held | 57/34 HS |
| 3,313,011 | 4/1967 | Loftin et al. | 57/157 TS X |
| 3,328,951 | 7/1967 | Potts et al. | 57/157 S |
| 3,733,801 | 5/1973 | Jones | 57/157 TS |
| 3,780,515 | 12/1973 | Waters | 57/157 S |
| 3,796,036 | 3/1974 | Parker | 57/157 TS |
| 3,828,542 | 8/1974 | Boutonnet | 57/157 TS X |

*Primary Examiner*—Donald E. Watkins
*Attorney, Agent, or Firm*—Armstrong, Nikaido & Wegner

[57] ABSTRACT

A method for manufacturing a textured synthetic multifilament yarn having alternately grouped S and Z twists. The textured yarn is produced by a conventional false-twist operation under a processing temperature between a softening point and a melting point of the material yarn in a first step and then the above-mentioned yarn is subjected to a process for separating individual filaments in each of the compact portions under tension.

5 Claims, 12 Drawing Figures

METHOD FOR MANUFACTURING A TEXTURED SYNTHETIC MULTIFILAMENT YARN HAVING ALTERNATELY GROUPED S AND Z TWISTS

SUMMARY OF THE INVENTION

The present invention relates to an improved method for manufacturing a textured synthetic multifilament yarn having alternately grouped S and Z twists, wherein one of the grouped S and Z twist portions is formed in compact condition and another twist portion is formed in bulky configuration.

In the conventional method for producing the crepe weave with thermoplastic synthetic multifilament yarn, after providing a heavy first twist, the twisted yarn is subjected to a heat set operation by applying dry or wet heat so as to set the twist imparted thereon; next, the yarn is untwisted until the number of twists per unit length of yarn is turned over the zero point so that a high bulky crimped yarn having strong potential torque is produced. This high bulky crimped yarn is then treated with a sizing agent so as to temporarily eliminate the above-mentioned potential torque of the yarn. The above-mentioned sizing agent is capable of desizing in a neutral or weak basic squaring condition. The high bulky yarn treated as mentioned above, or high bulky yarn without the above-mentioned treatment with size, is utilized for weaving a cloth as the weft yarn, or a pair of high bulky yarns provided with opposite twist directions, or a pair of two different groups of high bulky yarns having opposite twist directions are alternatively picked so as to pass through sheds of the warp and then, a desizing operation is applied upon a grey fabric produced by the above-mentioned weaving operation. According to this desizing operation, the potential torque of weft is developed so that numerous fine crepes can be formed on a finished fabric. The above-mentioned grey fabric is then treated by wet process with hot liquid, and mechanical or manual vibration is applied to the fabric during the desizing operation so that the potential torque of the weft yarn is effectively created and, consequently, fine crepes are formed on the fabric. Next, the crepe fabric is subjected to a conventional tenter drying operation so as to apply the heat-set treatment. If necessary, dyeing and finishing operations are further applied to the above-mentioned crepe fabric.

It is a recent tendency that the high bulky crimped multifilament yarn produced by a so-called false-twist texturing apparatus has been preferably used for producing crepe fabric, because of high productivity of the texturing apparatus, that is, high economic advantage. However, the potential torque of the false twisted textured yarn is generally not as strong as the first mentioned textured yarn produced by the twist-heat-set-untwist operation, so that the untwisting operation needs to be applied in excess to strengthen the potential torque. According to our experience, the crepe condition of the crepe fabric utilizing the falsetwist textured yarn is not sharp, so that the appearance thereof is rather flat in comparison with the crepe fabric utilizing a textured yarn produced by the twist-heat-set-untwist operation. Moreover, the feeling of the falsetwist textured yarn is fairly soft. Consequently, utilization of this type of crepe fabric is restricted.

on the other hand, it is understood that the crepe fabric utilizing a textured yarn produced by the twist-heat-set-untwist operation satisfies the quality requirement for many practical uses. However, it is impossible to satisfy a certain particular requirement for creation of a more distinctive crepe which is crisp to the touch.

To solve the above-mentioned particular requirement, several methods for producing a particular textured yarn have been introduced. One of them was disclosed in the Japanese Pat. No. 18072/1970, and another was presented by the Japanese Pat. No. 34976/1972. In the former method, a pair of multifilament yarns having different melting points are doubled and then this bundled yarn is subjected to a false-twisting operation under a particular temperature which is predetermined within a range between the abovementioned melting points. Consequently, the individual filaments of a multifilament yarn having a lower melting point are partially melted so that they are fused to each other. However, even if the above-mentioned purpose can be attained by utilizing this textured yarn, the crepe fabric produced is coarse and less soft to the touch. On the other hand, in the above-mentioned latter method, a plurality of multifilament yarns are firstly doubled and then subjected to heat treatment so as to partially fuse the individual filaments. Next this heat-treated yarn is subjected to the false-twist operation. As the individual filaments are partially fused during the false-twist operation, creation of the potential torque on the textured yarn by the false-twist operation tends to be degraded, moreover, the textured yarn becomes coarse to the touch.

To solve the above-mentioned particular requirment, a synthetic multifilament textured yarn having alternately grouped S and Z twists, wherein one of the grouped S and Z twist portions is formed in compact condition and the other twist portion s formed in bulky configuration, was introduced by co-pending U.S. patent application Ser. No. 357,533. However, in the method for producing the above-mentioned textured yarn, wherein the false-twist texturing operation is carried out under a processing temperature between a softening point and a melting point of the material yarn, it was observed that the compact portions of the textured yarn possibly contain fused portions where the individual filaments are fused to each other. If the textured yarn produced by the above-mentioned manufacturing method contains many fused portions, the appearance of the crepe fabric made by the above-mentioned textured yarn is very much degraded and, further, the feel of the fabric to the hand becomes bad.

The principal object of the present invention is to provide an improved method for manufacturing a synthetic multifilament textured yarn having alternately grouped S and Z twists, wherein one of the grouped S and Z twist portions is formed in compact but not fused condition and the other twist portion is formed in bulky configuration.

A further object of the present invention is to provide an improved method for manufacturing a synthetic multifilament textured yarn having superior bulkiness which can be preferably used for manufacturing knit wear goods.

According to the present invention, in the method for manufacturing the synthetic multifilament yarn having alternately grouped S and Z twists, wherein one of grouped S and Z twists portions is formed in compact but non-fused condition and the other twist portion is formed in bulky configuration, the material multifilament yarn is supplied into a conventional false-twist operation under a processing temperature between a softening point and a melting point of the material yarn as a first step, and then the processed yarn delivered from the above-mentioned conventional false-twist operation is subjected to a process for separating individual filaments in each of the compact portions under tension. The above-mentioned two steps of processing can be either continuously or independently carried out. Based on repeated mill tests, we confirmed that the textured yarn produced by the method of the present invention has superior property for producing a crepe fabric or knitted fabric.

DETAILED EXPLANATION OF THE INVENTION

Figure 1:
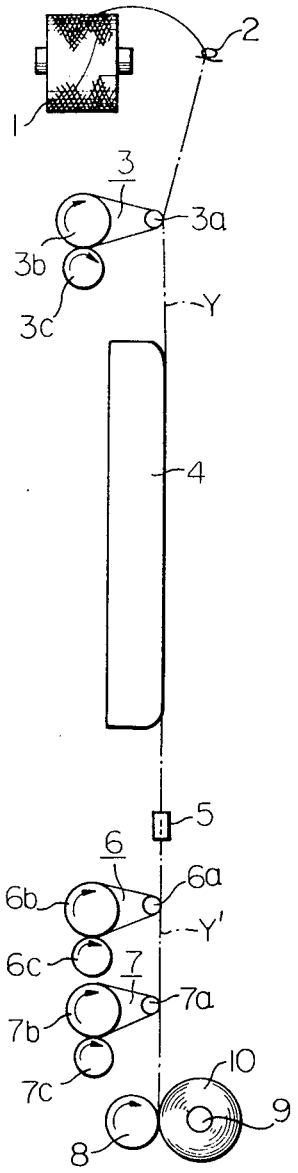
FIG. 1 is a schematic side view of an apparatus for carrying out the method for manufacturing a synthetic multifilament textured yarn according to the present invention.

For the sake of better understanding of the present invention, the method for manufacturing a synthetic multifilament textured yarn according to the above-mentioned copending patent application is briefly illustrated with reference to the apparatus shown in FIG. 1. A material synthetic multifilament yarn Y is supplied from a yarn package 1 and led to a supply roller means 3 via a yarn guide 2. Then the yarn is threaded through a false-twisting spindle 5 and led to a delivery roller means 6. A heater 4 is disposed at an intervened position of the yarn passage between the supply roller means 3 and the delivery roller means 6 so as to heat the yarn Y at a predetermined temperature.

Figure 2:
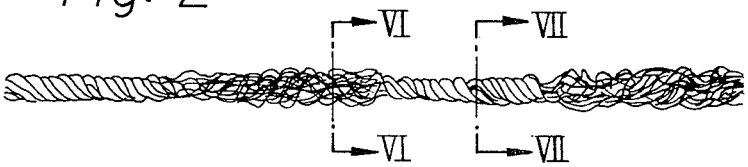
FIG. 2 is an enlarged elevation of a typical synthetic multifilament textured yarn produced by a method according to the present invention.
Figure 6:
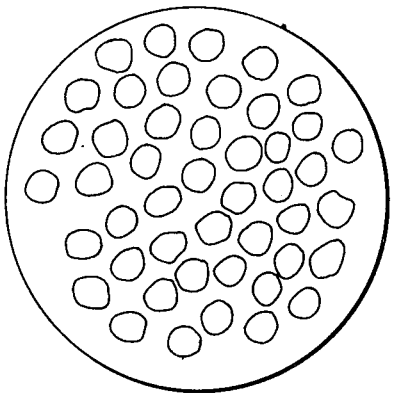
FIG. 6 is an enlarged sectional view of a bulky portion of the synthetic multifilament textured yarn taken, along a line VI-VI in FIG. 2.
Figure 7:
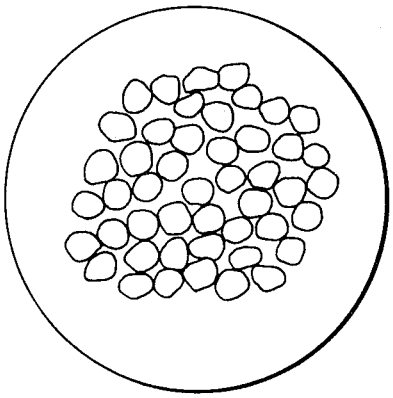
FIG. 7 is an enlarged sectional view of a compacted portion of the synthetic multifilament textured yarn, taken along a line VII—VII in FIG. 2.

In the conventional false-twisting apparatus, the false twisted yarn Y′ is then led to a winding mechanism provided with a friction drum 8 so as to produce a yarn package 10 formed on a bobbin 9. As disclosed in the above-mentioned false-twisting operation, the operation is carried out under a processing temperature between a softening point and a melting point of the material yarn. The resulting textured yarn produced by the above-mentioned false-twisting operation has a particular configuration characterized by alternately grouped S and Z twists wherein one of the grouped S and Z twists portions is formed in compact condition and the other twist portion is formed in bulky configuration. The typical configuration of the compacted portion of the above-mentioned yarn is as shown in FIG. 2, the individual filaments in contact with each other without adhering is as shown in FIG. 7, while in the bulky portion, the individual filaments are mostly separated from each other as shown in FIG. 6, and this yarn has a pertinent torque fit for producing a crepe fabric as illustrated in the specification of the above-mentioned co-pending patent application.

Figure 3:
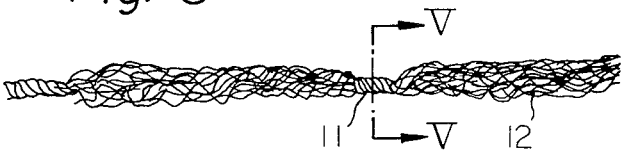
FIGS. 3 and 4 are enlarged elevations of defective portions of a synthetic multifilament textured yarn produced by a method disclosed in the above-mentioned co-pending patent application.
Figure 4:
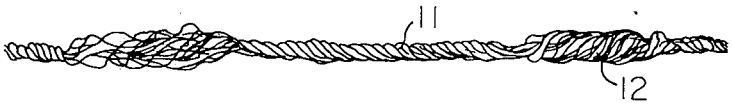
Figure 5:
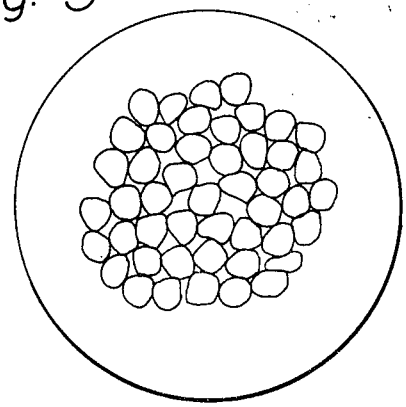
FIG. 5 is an enlarged sectional view of a defective portion of the synthetic multifilament textured yarn, taken along a line V—V in FIG. 3.

However, according to our experience, as the surface temperature of the heater 4 varies within a certain range of variation, the textured yarn produced by the abovementioned operation involves incorrectly processed portions such as shown in FIGS. 3 and 4. That is, a strictly compacted portion 11 is concentrated in a comparatively short length while a bulky portion 12 is formed in comparatively long length as shown in FIG. 3, or a strictly compacted portion 11 is formed in a comparatively long length while a bulky portion 12 is concentrated in a comparatively short length as shown in FIG. 4. Further in the strictly compact portion 11, the individual filaments tend to be in close contact with each other, and some of the individual filaments are fused to each other. If the above-mentioned strictly compact portion exists, the appearance of the crepe fabric made by this textured yarn is very much damaged, because many spotlike defects appear on the fabric surface. Moreover, if the above-mentioned fabric is subjected to a dyeing process, the poor appearance due to the above-mentioned effects can not be eliminated from the dyed crepe fabric. However, if in the compacted portion 11 the individual filaments are separated each other as shown in FIG. 7, the above-mentioned drawback of the textured yarn can be perfectly eliminated.

Figure 8:
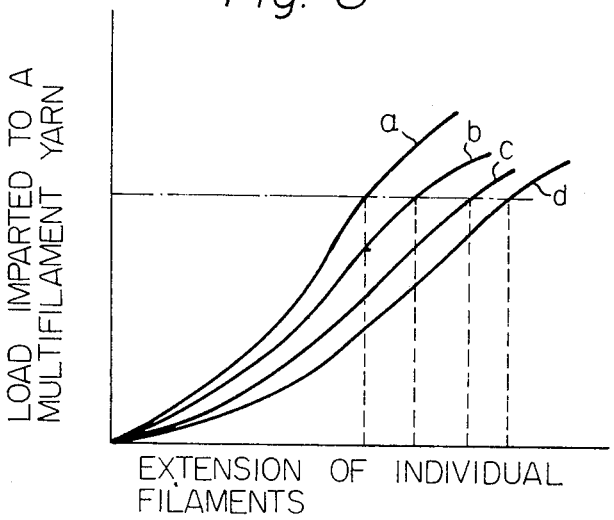
FIG. 8 is a diagram showing a relation between extensions or longitudinal deformations of individual filaments of a multifilament yarn and load imparted to the yarn.

It has been known that Young's modulus of individual filaments of a multifilament yarn varies within a certain range. For example, if four individual filaments a, b, c, and d are picked up from a multifilament yarn, and these four filaments are subjected to so-called a tensile test, diagrams showing the relation between load and elongation with respect to these four filaments *a*, *b*, *c* and *d* are obtained as shown in FIG. 8. As is clearly shown in FIG. 8 individual filaments extend in different manners under equal loads. In other words, it may be understood that, if a load is imparted to a yarn Y after the false-twisting operation, the individual filaments of the false-twisted yarn extend in different manners as shown in FIG. 8. Consequently, even if certain portions of the individual filaments of the compacted portions of the multifilament textured yarn are fused and adhered to each other in a weak condition, shears are created at the boundary portion between each pair of individual filaments where the filaments are adhered to each other so that the individual filaments of these fused portions can be separated, by applying a pertinent load, so as to create the longitudinal deformation of the individual filaments in the different manners as shown in FIG. 8. The above-mentioned concept for separating individual filaments absolutely in the compacted portion of the false-twisted multifilament textured yarn is the principle of the present invention. However, as the main purpose of the present invention is to provide a method for manufacturing a textured synthetic multifilament yarn having alternately grouped S and Z twists wherein one of the grouped S and Z twist portions is formed in compact condition and the other portion is formed in bulky configuration, it is necessary that the characteristic feature of the yarn not be changed when the above-mentioned action for separating individual filaments is applied. To satisfy this requirement, any excess load to deform the individual filaments over their elastic limit, which may be represented by 95% or 90% elastic recovery, should be avoided. According to the above-mentioned basic concept, a pertinent condition for separating individual filaments at the compacted portions of the false-twisted multifilament textured yarn depends upon the physical properties of the material yarn. As already explained, as the adhered portions of the individual filaments in the compacted portions of the false-twisted yarn can be separated by creating different longitudinal deformations of individual filaments, when the difference between the longitudinal deformations of individual filaments is larger the adhered portions of individual filaments can be more easily separated. Therefore, the practical problem is how to create the different longitudinal deformations of the individual filaments of the false-twisted multifilament textured yarn.

Referring to FIG. 1, in the apparatus for carrying out the method for manufacturing the synthetic multifilament textured yarn according to the present invention, means for creating longitudinal deformation of individual filaments of the yarn Y is disposed at a position downstream from the false-twisting spindle 5. That is, an additional roller means 7 is disposed at a position downstream from the delivery roller means 6. The supply roller means 3, delivery roller means 6 and the additional roller means 7 have identical construction as shown in FIG. 1. That is, these roller means comprise a small roller 3*a*, 6*a*, 7*a* rotatably supported by a bracket (not shown) and a large roller 3*b*, 6*b*, 7*b* rotatably supported by the same bracket and a driving roller 3*c*, 6*c*, 7*c* which drives the roller 3*b*, 6*b*, 7*b* by friction contact, respectively. Therefore, a desirable condition of the longitudinal extension of the yarn Y can be created by rotating the roller 7*b* at a faster surface speed that of the roller 6*b*. As the individual filaments of the yarn Y are arranged in entangled condition, when the yarn Y is stretched a certain extent, the individual filaments of the yarn Y receive uneven strain and the longitudinal deformation of the individual filaments varies according to the configuration of each individual filament in the yarn Y. Moreover, as the yarn Y moves on the surface of the small roller 6*a*, having a small diameter, under a certain tension, each individual filament is forced to bend. Consequently, the above-mentioned variation of the longitudinal deformation of the individual filament is enlarged.

To confirm the result of the above-mentioned concept of the present invention, the following experimental test was carried out.

EXAMPLE 1

A polyethyleneterephthalate multifilament yarn of 75 d/24 f was subjected to a false-twisting machine as shown in FIG. 1, under the following conditions.

| | | |
|---|---|---|
| (a) | Spindle r.p.m. | 300,000 |
| (b) | False-twist | 4300 t/meter S direction or Z direction |
| (c) | Processing temperature | 245°C |
| (d) | Percentage of over feed in yarn supply into the false-twist zone | +2% |
| (e) | Stretch ratio between the roller means 6 and 7 | 0, 0.5%, 1% 2%, 3% |
| (f) | Percentage of over feed to yarn winding | +5% |

Figure 9:
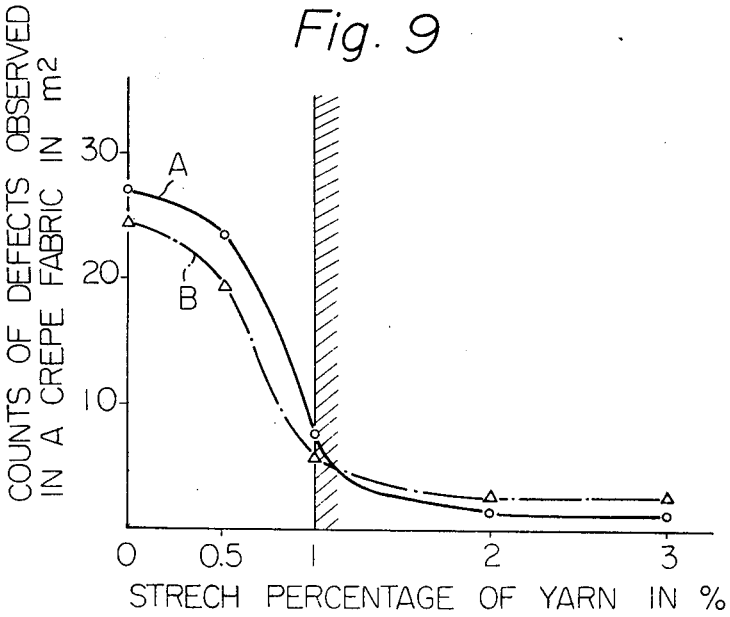
FIG. 9 is an explanatory diagram showing an extension imparted to a multifilament textured yarn in the process according to the present invention and count of defects observed in the crepe fabric made with the above-mentioned yarn.

Then the textured yarn produced by the above-mentioned method was utilized for producing a crepe fabric under the following condition.

a. Warp yarn
i. Polyethyleneterephthalate multifilament yarn of 50 d/36 f provided with an additional S twist of 250 t/meter
ii. Density of reed 95/38 cm 2 warp yarn/reed
b. Weft yarn
i. doubled picks with the above-mentioned textured yarn
ii. Direction of twist of the weft yarn was alternatively changed to S or Z false-twist at each double pick.
iii. Density: 125 picks/3.8 cm
c. Width of grey fabric 112.5 cm Next the grey fabric was wet treated in hot water. In this wet processing, mechanical vibration was applied to the grey fabric under relaxed condition. According to the above-mentioned wet processing, the grey fabric was shrunk very much and distinctive crepes were developed in the fabric. Next, the above-mentioned crepe fabric was subjected to a conventional tentering operation so that the crepes of the fabric were heat-set under a predetermined heat-set temperature. Thereafter, the fabric defects due to the compact portion of the yarn where individual filaments adhered to each other was measured. The relation between the count of these fabric defects/$m^2$ and the stretch percentage of the yarn is represented in FIG. 9, wherein A shows the relation in the case of the above-mentioned polyester and B shows the relation in the case of polyamide described hereinbelow. As it is clearly shown in the diagram of FIG. 9, it was confirmed that if the false-twisted yarn Y is stretched in a pertinent condition, the different longitudinal deformation of the individual filaments work to separate the individual filaments in the compacted portion of the yarn from each other, and that the pertinent condition is a stretch of the yarn over about 1% with respect to the above-mentioned synthetic yarn. However, if the adhering condition of the individual filaments is strong, it is naturally better to increase the above-mentioned stretch ratio. Further, to confirm the effect of the above-mentioned stretch operation upon a polyamide multifilament yarn, the stretch operation was applied in the condition of Example 3 disclosed in the above-mentioned co-pending application, and it was confirmed that to attain the desirable effect the lower limit of the stretch operation is 1%.

Figure 10:
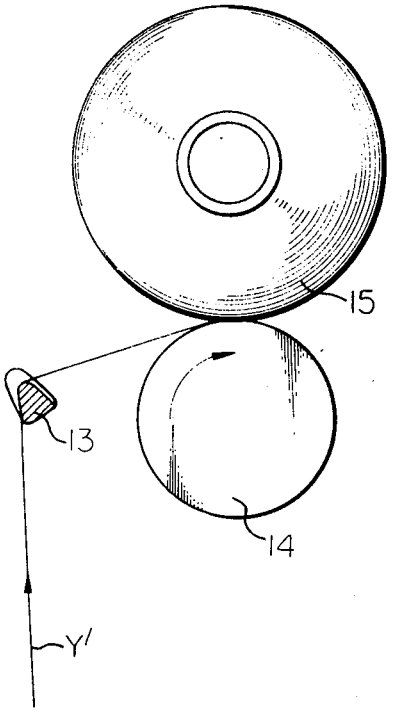
FIG. 10 is a schematic side view of a yarn feeding part of a rewinding apparatus.
Figure 11:
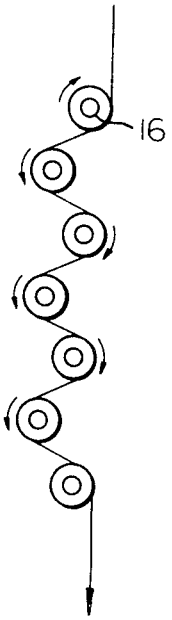
FIG. 11 is a schematic side view of a modified device for separating individual filaments of a compact portion of a false-twisted yarn according to the present invention.

In the above-mentioned embodiment, the stretch operation is carried out as a continuous process of the false twisting operation, however, according to our experiments, the stretch operation can be applied independently from the false-twisting operation. That is, as shown in FIG. 10 when the synthetic multifilament false twisted yarn produced by the method disclosed in the above-mentioned co-pending patent application is subjected to a rewinding operation, if the rewinding tension is fixed so as to create an extension of more than 1%, the individual filaments of the compacted portions of the yarn are preferably separated after passing through a yarn guide 13. In the drawing of FIG. 10, the reference numerals 14 and 15 represent a split drum and a yarn package, respectively.

It is also practical to pass the yarn Y′ through a plurality of small rollers rotatably mounted on a bracket (not shown) so as to separate the individual filaments in the compacted portions of the false-twisted multifilament yarn produced by the method according to the above-mentioned co-pending patent application. This is because, when the false-twisted multifilament yarn Y′ passes through the small rollers 16, the yarn Y′ is forced to bend under a stretched condition. This type of roller assembly may be utilized in the false-twisting apparatus at a position between the delivery roller means and the winding mechanism.

According to our experience, when the multifilament textured yarn manufactured by the present invention is utilized for producing a knitted fabric, a problem due to the creation of snarls disturbs the yarn feeding operation. As the snarls are created by the distinguished torque of the yarn, there are two ways to eliminate the snarl problem. One way is the application of an additional twisting upon the above-mentioned textured yarn, and the other way is the treatment of the above-mentioned textured yarn under a temperature between a softening temperature and a melting temperature of the yarn material. This second heat treatment may be carried out simultaneously with the stretching operation. The following examples were carried out to ascertain the effect of the additional twisting or additional heat set treatment.

EXAMPLE 2

After producing the false twisted yarn in Example 1, an additional twist of 150 t/meter was applied to the yarn by a conventional ring twister. The twist direction was identical to the direction of the false-twisting.

According to this additional twisting, it was confirmed that the creation of snarls is preferably eliminated.

EXAMPLE 3

Figure 12:
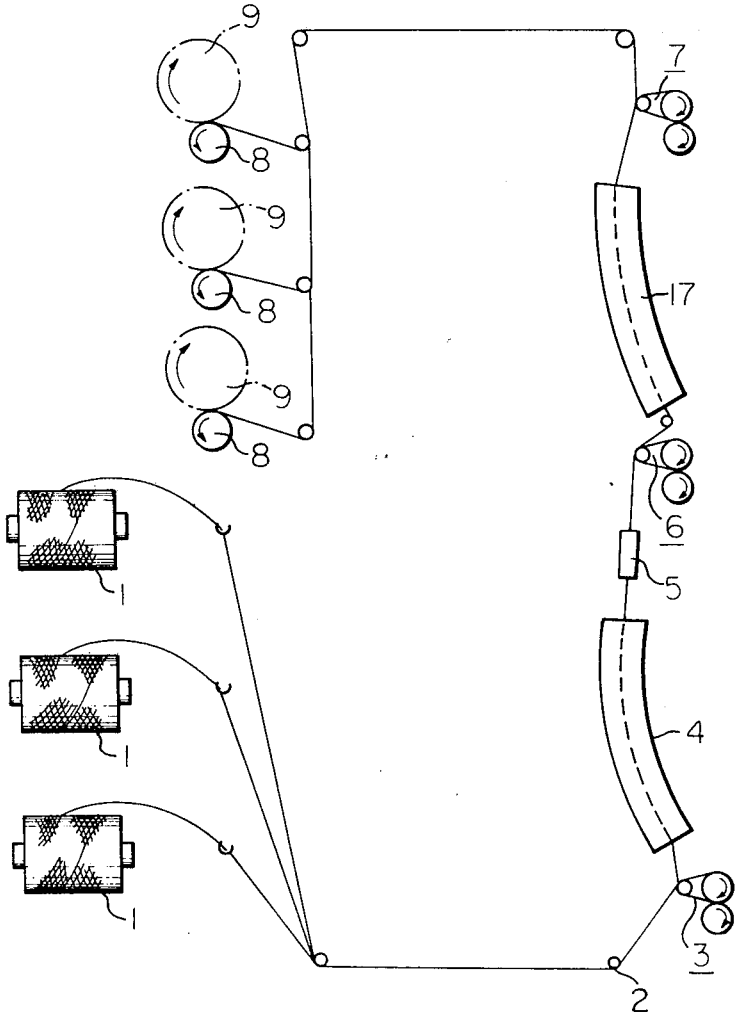
FIG. 12 is a modified embodiment of the apparatus for carrying out the method for manufacturing a synthetic multifilament textured yarn according to the present invention.

A polyester multifilament yarn of 150 d/48 f was used for manufacturing a false-twisted yarn, under the conditions shown below, by a conventional apparatus which is called an LS-6 false-twisting machine sold by Mitsubishi Heavy Industry Co., japan. A schematic side view of this machine is shown in FIG. 12, wherein a second heater 17 is disposed between the delivery roller means 6 and the stretching roller means 7 in FIG. 1.

| Condition | Test A | B |
|---|---|---|
| (a) Spindle r.p.m. | 300,000 | same as A |
| (b) Number of the false-twist | 2800 T/M | " |
| (c) Processing temperature of the first heater | 250°C | " |

-continued

| Condition | Test A | B |
|---|---|---|
| (d) Percentage of over-feed in a yarn supply | +2% | " |
| (e) Stretch ratio in a stretching zone | 1% | 0.1% |
| (f) Processing temperature of the second heater | 220°C | same as A |
| (g) Percentage of over-feed to yarn winding | +5% | +8% |

The above-mentioned false-twisted yarns were used for producing a knitted fabric (double picque) by a circular knitting machine of 18 gauge. However, it was very difficult to supply the yarn B to the knitting machine, because of frequent trouble due to snarls. Contrary to this, the yarn A could be handled easily, and the resulted knitted fabric after conventional dyeing had a beautiful appearance, a superior feel to the hand and a preferable drape characteristic.

EXAMPLE 4

A polyamide (Nylon 6) multifilament yarn of 120 d/30 f was subjected to a false-twisting machine as shown in FIG. 12, under the following conditions.

| | | |
|---|---|---|
| (a) | Spindle r.p.m. | 320,000 |
| (b) | False-twist | 3,200 t/meter |
| (c) | Temperature of first heater (4) | 205°C |
| (d) | Temperature of second heater (17) | 200°C |
| (e) | Percentage of over-feed in yarn supply into the false-twisting zone | −3% |
| (f) | Stretch ratio between the roller means 6 and 7 | 2% |
| (g) | Percentage of over-feed to yarn winding | +4% |

The obtained yarn was knitted into milano rib stitch by a circular knitting machine of 20 gauge. During the knitting operation, there was little trouble and the fabric obtained by being subsequently dyed and finished possessed good properties for clothes, especially for ladies.

What is claimed is:

1. In a method for producing a synthetic multifilament textured yarn having compact and bulky portions comprising feeding a material multifilament yarn to a supply roller means, false-twisting said yarn fed from said supply roller means, delivering said false-twisted yarn by a delivery roller means, winding said false-twisted yarn delivered from said delivery roller means under an over-feed condition, an improvement comprising in combination, carrying out said false-twisting operation under a processing temperature within a range between a softening temperature and a melting temperature of the yarn, stretching said false-twisted yarn in a restricted condition below a limit of elastic deformation thereof, whereby the individual filaments in the compact portions are substantially separated from each other.

2. An improved method for producing a synthetic multifilament textured yarn according to claim 1, wherein said stretching operation is carried out in a condition of not less than 1% elongation of individual filaments.

3. An improved method for producing a synthetic multifilament textured yarn according to claim 1, further comprising an application of a second heat treatment to said false-twisted yarn at a processing temperature within a range between a softening temperature and a melting temperature thereof.

4. An improved method for producing a synthetic multifilament textured yarn according to claim 1, wherein said stretching operation is carried out at a yarn passage downstream from said delivery roller means and before winding the yarn on a yarn package, as a continuous process.

5. An improved method for producing a synthetic multifilament textured yarn according to claim 3, wherein said second heat treatment is carried out at a yarn passage downstream from said delivery roller means and before winding the yarn on a yarn package, and said stretching operation is carried out simultaneously with said second heat treatment.

* * * * *